US009062456B2

(12) United States Patent
Kollegger et al.

(10) Patent No.: US 9,062,456 B2
(45) Date of Patent: Jun. 23, 2015

(54) SUPPORT CONSTRUCTION HAVING INCREASED STRUCTURAL DAMPENING

(75) Inventors: Johann Kollegger, Klosterneuburg (AT); Philipp Egger, Bozen (IT); Herbert Pardatscher, Vienna (AT)

(73) Assignee: VSL INTERNATIONAL AG, Koniz (CH)

( * ) Notice: Subject to any disclaimer, the term of this patent is extended or adjusted under 35 U.S.C. 154(b) by 424 days.

(21) Appl. No.: 13/256,950

(22) PCT Filed: Mar. 16, 2010

(86) PCT No.: PCT/EP2010/053345
§ 371 (c)(1),
(2), (4) Date: Nov. 18, 2011

(87) PCT Pub. No.: WO2010/106047
PCT Pub. Date: Sep. 23, 2010

(65) Prior Publication Data

US 2012/0047846 A1 Mar. 1, 2012

(30) Foreign Application Priority Data

Mar. 18, 2009 (AT) ..... A 437/2009

(51) Int. Cl.
*E04C 5/08* (2006.01)
*E01D 6/02* (2006.01)
(Continued)

(52) U.S. Cl.
CPC . *E04B 1/985* (2013.01); *E01D 6/02* (2013.01); *E04H 9/02* (2013.01); *E04H 9/028* (2013.01)

(58) Field of Classification Search
USPC ..... 52/1, 167.1, 167.4, 223.4; 188/268, 188/322.5, 381; 267/136
See application file for complete search history.

(56) References Cited

U.S. PATENT DOCUMENTS 774,441 A * 11/1904 Luck ..... 256/50
3,101,744 A * 8/1963 Warnaka ..... 138/139
(Continued)

FOREIGN PATENT DOCUMENTS

| | | |
|---|---|---|
| DE | 1162137 | 1/1964 |
| DE | 10138250 | 9/2002 |
| JP | 10047004 | 2/1998 |

OTHER PUBLICATIONS

Christian Petersen, Schwingungsdampfer im Ingenieurbau (Vibration Dampers in Structural Engineering), Maurer Sohne GmbH & Co KG, Munich, 2001, chapter 2, p. 43-44 (see p. 3, paragraph 1 of application specification for explanation of relevance).
(Continued)

*Primary Examiner* — Brian Glessner
*Assistant Examiner* — Joseph J Sadlon
(74) *Attorney, Agent, or Firm* — Pearne & Gordon LLP

(57) ABSTRACT

In a load-bearing construction (1) having at least one load-bearing element (2), the load-bearing element (2) has at least one cavity (5) in which at least one rod (4) is disposed, the total cross-sectional area of all rods (4) each arranged in a cavity (5) being smaller than the cross-sectional area of this cavity (5), and the remaining volume of the cavity (5) being filled with a material (6). The rod (4) is displaceable along its length relative to the load-bearing element (2) when the load-bearing element (2) is deformed, the rod (4) being non-displaceably fixed at only one point relative to the load-bearing element (2) and being designed such that it dissipates energy upon the occurrence of a relative displacement with respect to the load-bearing element (2).

19 Claims, 8 Drawing Sheets

Figure 1:
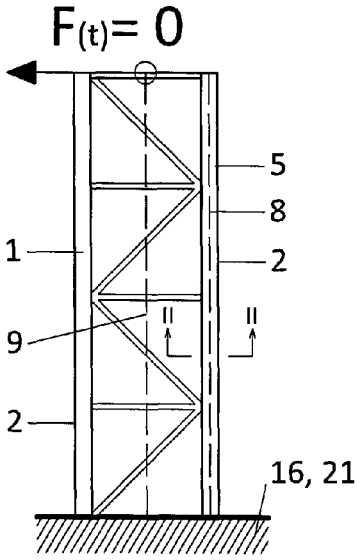

(51) Int. Cl.

| | |
|---|---|
| ***E04B 1/98*** | (2006.01) |
| *E04H 9/02* | (2006.01) |

(56) References Cited

U.S. PATENT DOCUMENTS

| | | | | | |
|---|---|---|---|---|---|
| 3,503,600 | A * | 3/1970 | Rich | 267/116 |
| 3,691,712 | A * | 9/1972 | Bowling et al. | 52/393 |
| 4,111,166 | A * | 9/1978 | Alstrin et al. | 123/323 |
| 4,706,788 | A * | 11/1987 | Inman et al. | 188/378 |
| 4,720,882 | A * | 1/1988 | Gallo | 14/73.5 |
| 5,727,663 | A * | 3/1998 | Taylor | 188/378 |
| 5,868,894 | A * | 2/1999 | Frenkel | 156/281 |
| 6,152,042 | A * | 11/2000 | Barry et al. | 104/26.2 |
| 6,499,570 | B2 * | 12/2002 | Chu | 188/129 |
| 6,701,680 | B2 * | 3/2004 | Fanucci et al. | 52/167.3 |
| 7,051,849 | B2 * | 5/2006 | Browne et al. | 188/267 |
| 7,264,095 | B2 * | 9/2007 | Domange | 188/280 |
| 7,288,326 | B2 * | 10/2007 | Elzey et al. | 428/593 |
| 7,735,483 | B2 * | 6/2010 | Papageorgiou | 126/571 |
| 7,793,645 | B2 * | 9/2010 | Walk et al. | 124/89 |
| 7,996,944 | B2 * | 8/2011 | Kollegger | 14/77.1 |
| 8,215,068 | B2 * | 7/2012 | Bongiorno | 52/167.8 |
| 2005/0257490 | A1 * | 11/2005 | Pryor et al. | 52/736.3 |
| 2009/0260304 | A1 * | 10/2009 | Mochimaru et al. | 52/167.1 |
| 2010/0101160 | A1 | 4/2010 | Bongiorno | |

OTHER PUBLICATIONS

International Search Report dated Aug. 2, 2010 for International Application No. PCT/EP2010/053345.

International Preliminary Report on Patentability and Written Opinion of the International Searching Authority dated Sep. 20, 2011 for International Application No. PCT/EP2010/053345.

Matthias Kroeger, Reibleistendampfung in Leichtbaustrukturen, PAMM Proceedings in Applied Mathematics and Mechanics, Wiley Interscience, vol. 3, Jan. 2003, p. 114-115.

* cited by examiner

SUPPORT CONSTRUCTION HAVING INCREASED STRUCTURAL DAMPENING

The invention relates to a load-bearing construction with at least one load-bearing element according to the preamble of claim 1.

The load-bearing construction can be a high-rise building, a chimney, a tower or a bridge, for example.

A load-bearing construction is made up of load-bearing elements such as, for instance, rods, beams, panels or plates. A load-bearing construction in the area of application of construction engineering has at least one support bed. Serving as support bed can be site or foundation structures.

In load-bearing constructions, vibrations can be brought about by dynamic influences (earthquake, wind, pedestrians on bridges, etc.). There are various methods of reducing vibrations:

Changing the frequency characteristics

To reduce vibrations, one countermeasure is a shift of the eigenfrequency so that the distance to the excitation frequency is as great as possible.

Vibration isolation

The eigenfrequency of the load-bearing construction and thereby the vibration reduction can be influenced by appropriate setting of dimensions, damping and stiffness of the mounting.

Vibration dampers with viscous damping characteristics

A vibration damper is an extra mass coupled to the load-bearing construction by means of a spring and a damping element.

Tuned mass dampers

A tuned mass damper is an extra mass coupled to the load-bearing construction by means of a spring.

Changing the damping of the structure

The amount of damping has a decisive influence on the vibration reduction in the resonance range. A distinction is made between damping in the construction material, damping in construction components and connecting means, and damping from the support and foundations.

Changing the frequency characteristics is an excellent way of reducing vibrations if the excitation frequency is known, for example for a given frequency from the operation of a machine. In construction engineering, one tries to shift the eigenfrequency of pedestrian bridges and grandstands out of the frequency range which can be caused by pedestrians or crowds of people.

Vibration isolation requires a large amount of additional work to isolate the construction and to absorb large horizontal displacements which occur, for example, in a vibration-isolated construction during an earthquake.

Vibration dampers and tuned mass dampers are constructions which entail high installation and maintenance work or costs.

Increasing the damping of structures is a suitable method of reducing the vibration of load-bearing constructions in the resonance range and for dissipating the energy for example of the effect of an earthquake.

The energy delivered by the earthquake sets the load-bearing construction in oscillation. A failure of the load-bearing construction can be prevented if an effective energy absorption through dissipation of the delivered energy takes place at as many points as possible and at the same time the transfer of the vertical load (weight of the construction itself and load) is ensured. In load-bearing constructions of steel, diagonal rods, for example, can be connected eccentrically to the beam. With lateral displacement of the load-bearing construction as a result of an earthquake stress, plastic hinges develop in the beam, in which plastic hinges energy is dissipated through cyclic-plastic deformations.

In Christian Petersen, *Schwingungsdämpfer im Ingenieurbau* (*Vibration Dampers in Construction Engineering*), published by Maurer Söhne GmbH & Co. KG, Munich 2001, chapter 2, p. 43 and 44, a technique is described for increasing the structural damping for the hangers of tied arch bridges. Two steel rods are fixed to the hanger (load-bearing element), and are displaceably fastened to the hanger at several points using ties. Under an oscillatory loading, the frictional forces in the ties cause a markedly increased structural damping. Petersen writes that the solution he describes is technically difficult to implement and in particular the corrosion protection is problematic.

The object of the present invention is to create a load-bearing construction with increased structure damping which has a simple design and does not incur any additional costs for corrosion protection measures.

This object is achieved through a load-bearing construction with the characterizing features of claim 1.

The load-bearing construction according to the invention comprises at least one load-bearing element with at least one cavity and at least one rod communicating with the cavity. The cavity is filled with a material such that, if the load-bearing element is deformed, the rod is displaceable along its length relative to the load-bearing element, the rod being non-displaceably fixed at least at one point relative to the load-bearing element, the rod being designed such that it dissipates energy when there is a displacement relative to the load-bearing element. "Dissipate" means the conversion from one form of energy into heat.

In an embodiment of the invention, the load-bearing element comprises at least one cavity in which at least one rod is disposed. The total cross-sectional area of all the rods arranged in each cavity is smaller than the cross-sectional area of the cavity, and the remaining volume of the cavity is filled with a material. The rod can move along its length relative way to the load-bearing element when the load-bearing element is deformed. A high energy dissipation is attainable using this design. For a greater deformability of the rod, the rod can be non-displaceably fixed relative to the load-bearing element at only one point, and such that it dissipates energy when there is a relative displacement relative to the load-bearing element.

In an especially easy-to-manufacture embodiment of the load-bearing construction according to the invention, the rod is of tubular design and defines in its interior the cavity in which the material is received, the material being implemented as a liquid, whereby the rod changes the volume of the cavity upon deformation of the load-bearing element, so as to cause a displacement between the material and the rod.

A "rod" is defined in structural analysis as only being capable of bearing tensile and compressive forces. Of course, bending moments can also occur in a rod, which are however of a considerably smaller order of magnitude when compared with a beam. Rods, in the sense of the invention, are considered to be steel rods with round or rectangular cross section, tension wire strands, steel cables having a considerable stiffness, hollow sections of steel (round or polygonal) and rods, strands and wires of fibre-reinforced composite material.

Due to the fixing of the rod relative to the load-bearing element at a single point, and the longitudinally displaceable implementation of the rod relative to the load-bearing element, relative displacements between rod and load-bearing element can occur when deformations of the load-bearing element occur. These relative displacements are negligible at the point where the rod is fixed relative to the load-bearing element. With increasing distance from this point of fixation, the relative displacements between rod and load-bearing element become greater. In the case of a dynamic influence upon the load-bearing construction, cyclical relative displacements between rod and load-bearing element will occur at every point of the rod.

Binding stresses can be transferred between rod surface and load-bearing element, for example through friction or through the material located in the cavity. The cyclical sequence of binding stress/relative displacement relations offers the possibility of dissipating energy. Depending upon the design of the rod and the binding stresses which are generated through the relative displacements, energy will be dissipated along the rod. For good dissipation, rods made of a metallic material or a fibre-reinforced composite are recommended.

To increase the friction between rod and cavity inner surface and thereby promote the dissipation, it is advantageous if the surface of the rod and/or the inner surface of the cavity has/have a ribbing, a threading, a pattern, swelling or indentations. The same purpose can be served by strip-shaped, prismatic or cylindrical elements attached to the surface of the rod.

To achieve considerable dissipation, a further embodiment of the invention envisages that the length of the cavity amounts to at least ten times its greatest diameter. In this context it has been shown to be favourable if the cavity has a cylindrical or prismatic shape.

For example, if the diameter or the height of the cross section of the rod is between 10 mm and 200 mm, the radius of inertia (gyration) will be between 2.5 mm and 58 mm.

The material with which the volume of the cavity between rod surface and load-bearing element is filled can advantageously consist of a liquid, a granular material, a gas or a mixture of the aforementioned materials.

If a liquid is used as the material for filling the cavity, then shearing stresses are transferred into the liquid when there are relative displacements between rod and load-bearing element. The occurrence of shearing stresses and the friction connected therewith between the filaments of flow of the liquid results in energy dissipation. In the case of both laminar and turbulent flow, kinetic flow energy is thus converted into heat.

Liquids with different viscosities, in particular kinematic viscosities in the range of $10^{-6}$ [$m^2/s$] to 1 [$m^2/s$] are suitable as material for filling of the cavity. For example, water can be used, with a kinematic viscosity of $10^{-6}$ [$m^2/s$] at ambient temperature, or hydraulic oil, with a kinematic viscosity of $10^{-2}$ [$m^2/s$] at ambient temperature.

A preferred filling medium for damping elements is silicone oil. Silicone oils are produced for a wider range of applications, with kinematic viscosities of $10^{-6}$ [$m^2/s$] to 1 [$m^2/s$]. Of particular significance are methyl silicone oils. They are colourless, odourless, non-toxic and hydrophobic. They have a high resistance to acids and bases. At ambient temperatures they are practically non-volatile. The melting point is at −50° C., the flashpoint at 250° C. and the ignition temperature at about 400° C. The density is about 970 $kg/m^3$.

Methyl silicone oils have a large range of viscosities and a minimal dependence of the viscosity on the temperature. A further characteristic is the high compressibility. Thus, even with very high compressive load, there is no risk of solidification of the silicone oil.

Materials for filling the cavity with granular material comprise, for example, sand, gravel, steel balls, balls of synthetic material or plastic, balls of aluminium or metallic balls with a covering of synthetic material or plastic. Also a combination of solid filling materials, for instance of granular material with liquids, are suitable for the filling of the cavity.

Air or nitrogen can be used, among others, as gaseous filling media.

A thixotropic fluid could also be used as filling medium. In some non-Newtonian fluids, the viscosity decreases with a mechanical stress. With elimination of the stress, the initial viscosity is restored.

To facilitate the maintenance of the load-bearing construction according to the invention, the rod and/or the material can be replaceable.

It is advantageous if the cavity is sealable in a tight way to prevent corrosion or penetration of dirt into the cavity.

A further increase of the dissipation through the rod is obtained if at least one section of the cavity in which the rod passes has a curvature or bend.

In a preferred embodiment of the load-bearing construction according to the invention, the cavity in the load-bearing element is disposed at a distance from the centroidal axis of the load-bearing element. The greater the distance is selected to be, the greater the relative displaceability of the rod and thus the dissipation.

A good damping of oscillations is obtained in a load-bearing construction according to the invention if the dimensions of the load-bearing construction along its centroidal axis are at least ten times greater than the cross sections orthogonal to the centroidal axis, and when a load-bearing element is disposed approximately parallel to, and at a distance from, the centroidal axis of the load-bearing construction.

In a favourable embodiment of the invention, the load-bearing element is composed of concrete or masonry, the cavity being formed by means of a tube. The tube is put in the concrete or masonry during the manufacture of the load-bearing element.

To increase the friction further, it is advantageous if the surface of the tube facing the cavity and/or the surface of the tube facing the load-bearing element have a ribbing, a pattern, swelling or indentations.

Another preferred embodiment of the load-bearing construction according to the invention is distinguished in that the rod is disposed outside the load-bearing element in a hollow section, in that the hollow section is disposed next to the load-bearing element and is firmly connected thereto at least three points, in that the cross-sectional area of the rod is smaller than the inner cross-sectional area of the hollow section and in that the remaining volume in the hollow section is filled with a material.

Figure 2:
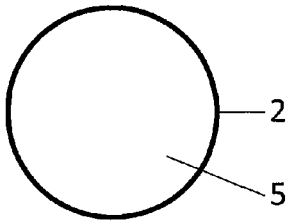

The according to the invention <sic. the invention> will be explained more closely in the following with reference to embodiment examples shown in the drawings. Shown are:

FIG. 1 a section of a load-bearing construction with a cavity disposed in a load-bearing element FIG. 2 a section along the line II-II of FIG. 1

Figure 3:
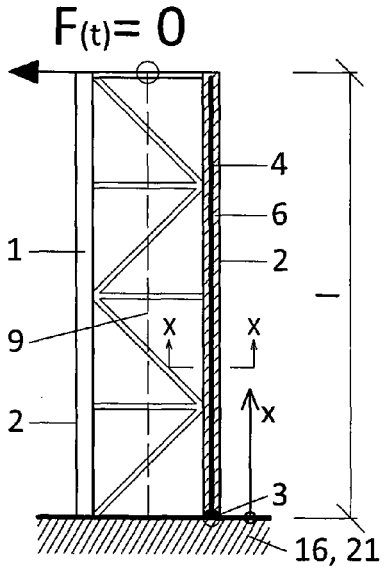
Figure 4:
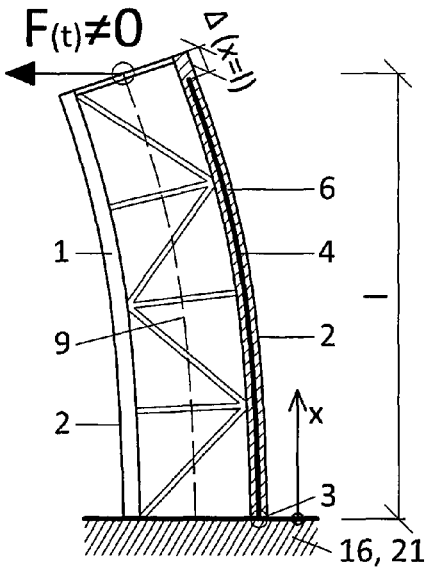
Figure 5:
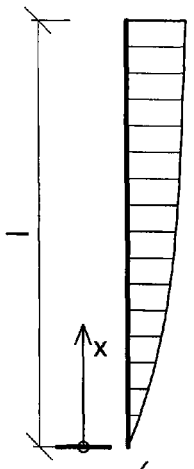
Figure 6:
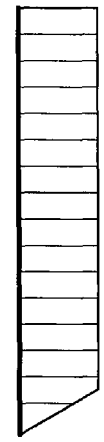
Figure 7:
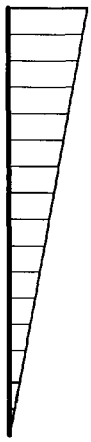
Figure 8:
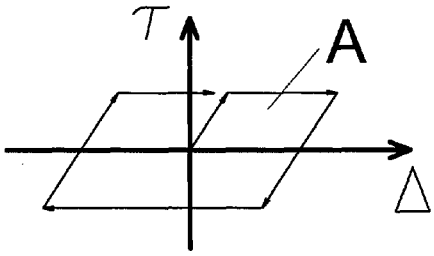
Figure 9:
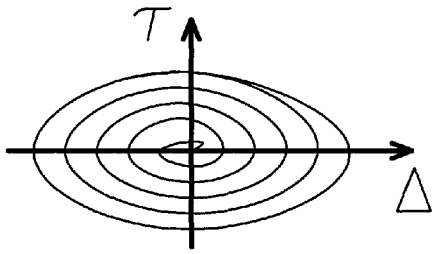
Figure 10:
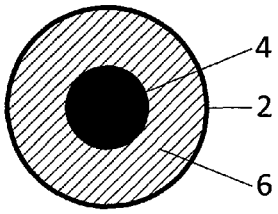
Figure 11:
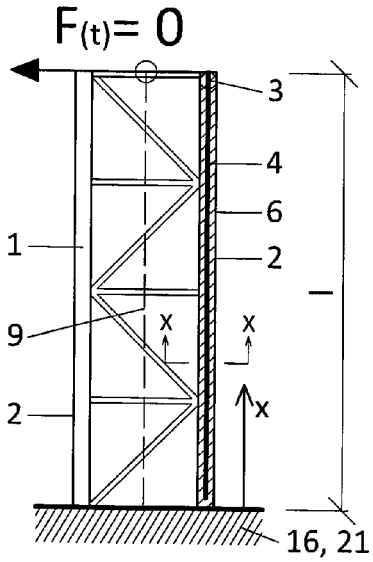
Figure 12:
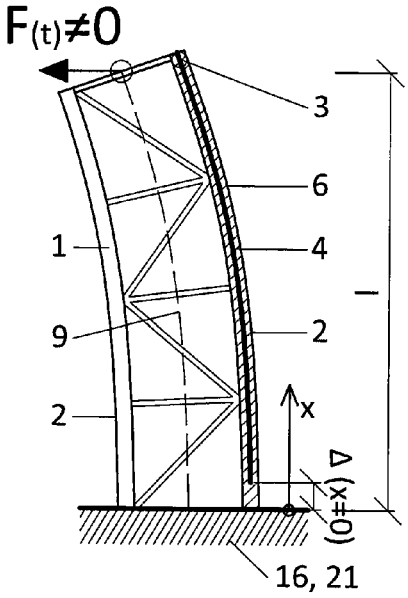
Figure 13:
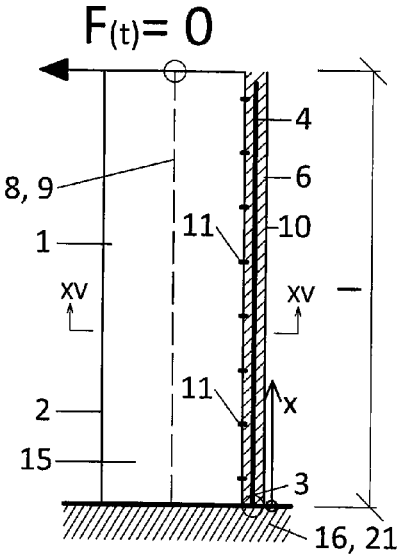
Figure 14:
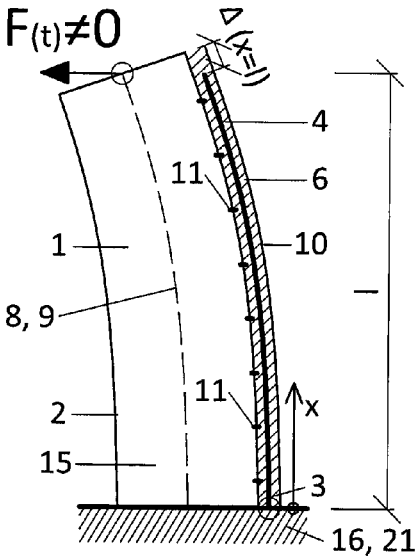
Figure 15:
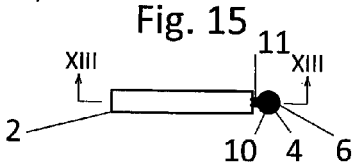
Figure 16:
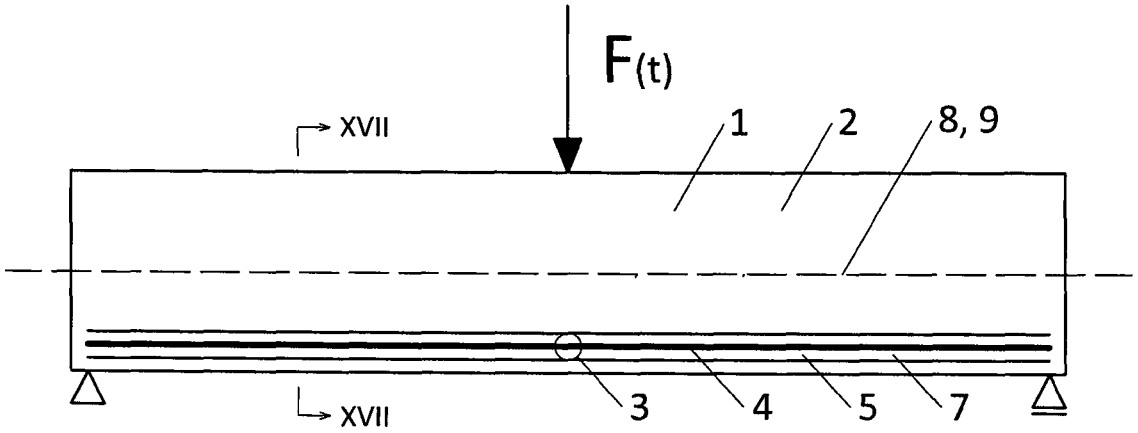
Figure 17:
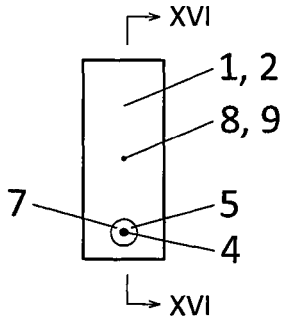
Figure 18:
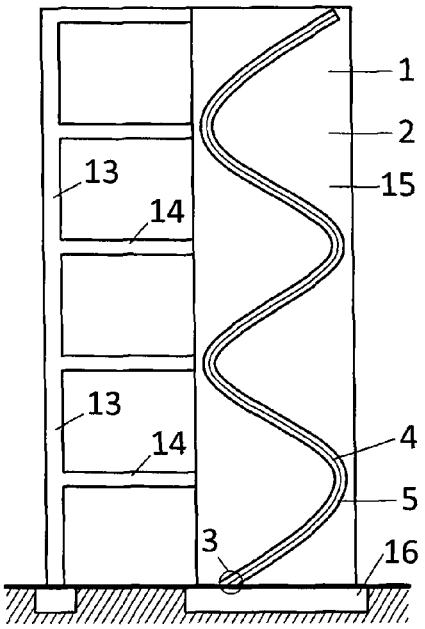
Figure 19:
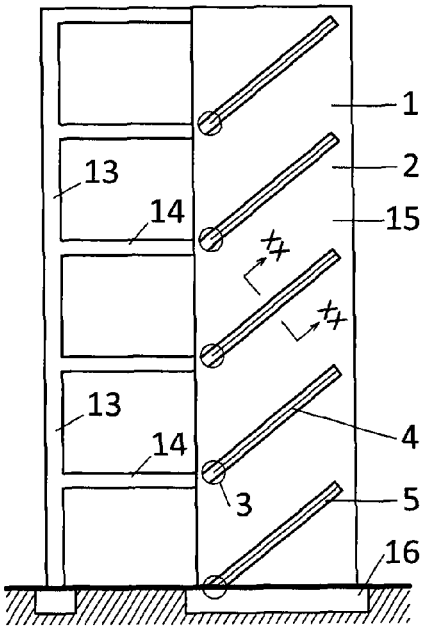
Figure 20:
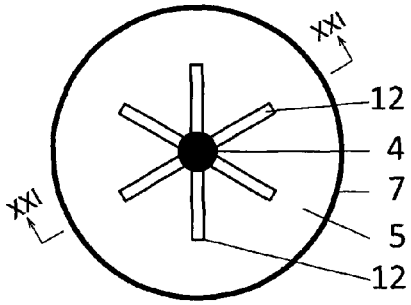
Figure 21:
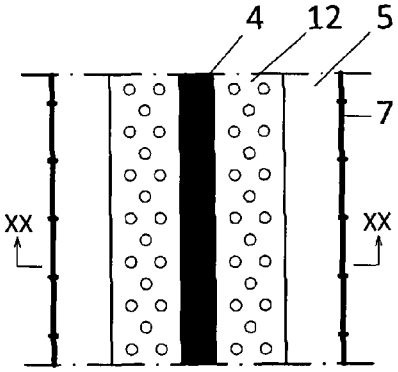
Figure 22:
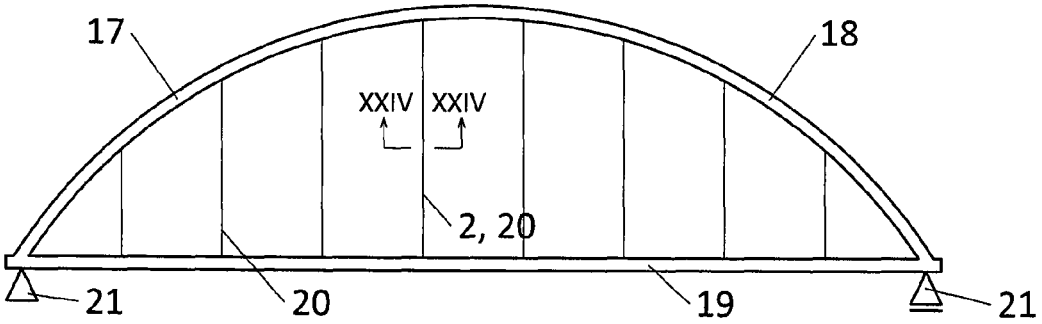
Figure 23:
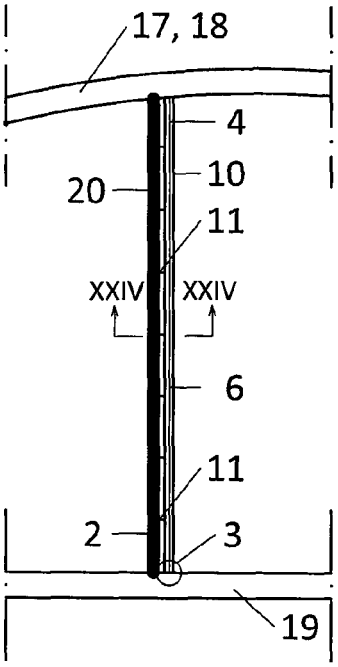
Figure 24:
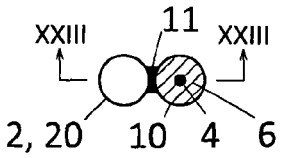
Figure 25:
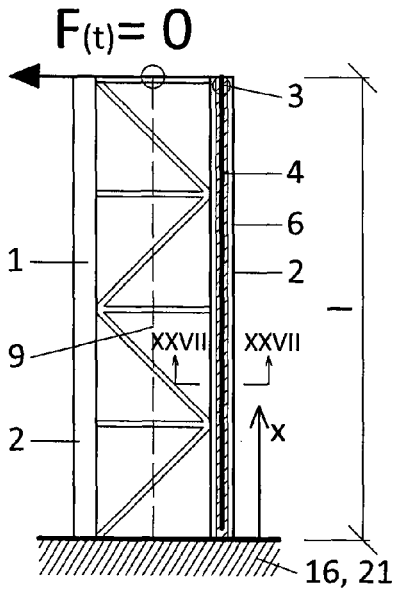
Figure 26:
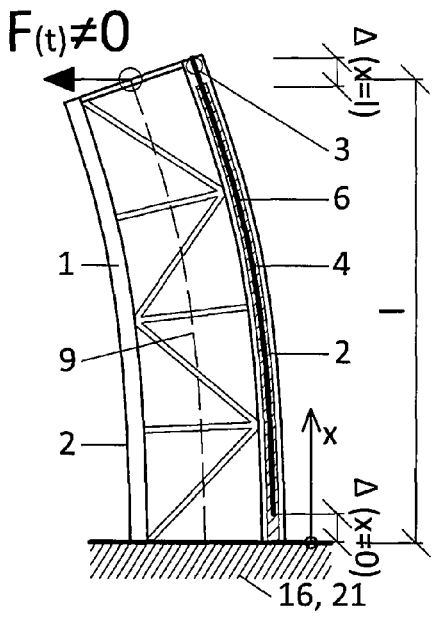
Figure 27:
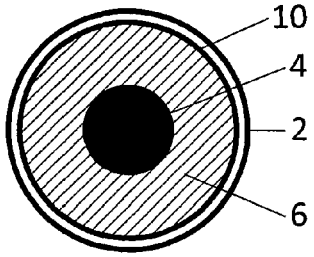
Figure 28:
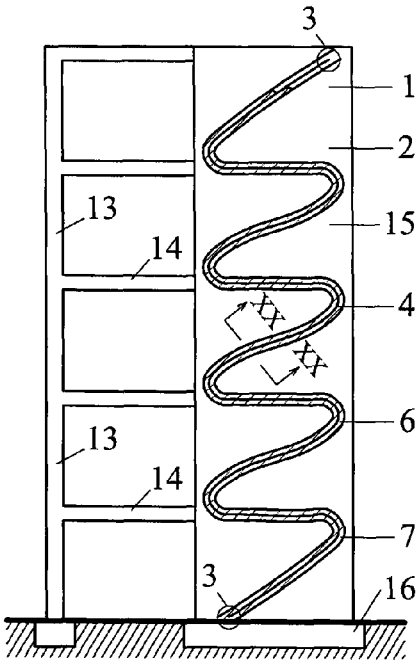
Figure 29:
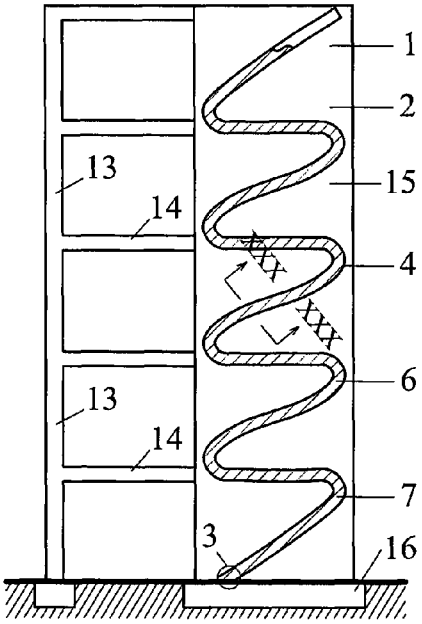
Figure 30:
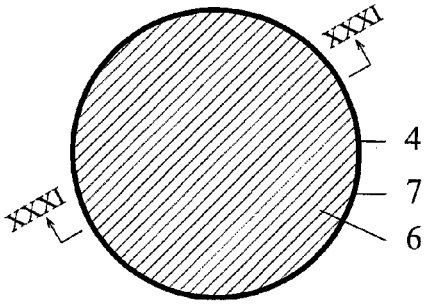
Figure 31:
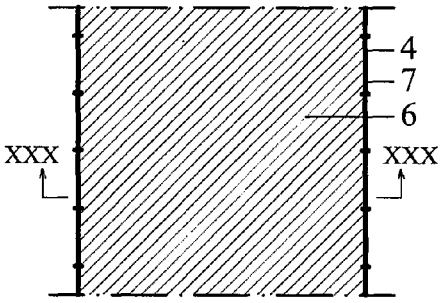

FIG. 3 a section of the load-bearing construction 1 according to FIG. 1 with a rod installed in a load-bearing element, which rod has an anchorage on the support bed of the load-bearing construction 1, FIG. 4 a section of the load-bearing construction according to FIG. 3 in the deformed state, FIG. 5 the course of the relative displacement Δ between rod and load-bearing element along the rod, FIG. 6 the course of the shear τ along the rod, FIG. 7 the course of the tensile force Z along the rod, FIG. 8 a shearing stress τ-relative displacement Δ-relationship for a material, which dissipates energy in every load cycle, the τ-Δ-relationship being characterized by an elastic-plastic behaviour, FIG. 9 a shearing stress τ-relative displacement Δ-relationship for a material, which dissipates energy in every load cycle, the τ-Δ-relationship being characterized by a viscous behaviour, FIG. 10 a section along the line X-X of FIG. 3, FIG. 11 a section corresponding to FIG. 3 through the load-bearing construction with a holding of the rod at the upper end, FIG. 12 a section of the load-bearing construction according to FIG. 11 in the deformed state, FIG. 13 another embodiment of a load-bearing construction with a hollow section disposed outside the load-bearing construction in which hollow section a rod is located, FIG. 14 a section of the load-bearing construction according to FIG. 13 in the deformed state, FIG. 15 a section along the line XV-XV of FIG. 13, FIG. 16 a further embodiment of a load-bearing construction with a rod having a fixture in the rod middle, and FIG. 17 a section along the line XVII-XVII of FIG. 16, FIG. 18 a load-bearing construction comprising support members, beam and a rod installed curved in a wall, FIG. 19 a load-bearing construction in accordance with FIG. 18 with five rods installed in a wall, FIG. 20 a section along the line XX-XX of FIG. 19, FIG. 21 a section along the line XXI-XXI of FIG. 20, FIG. 22 a tied arch bridge, FIG. 23 a hanger of the tied arch bridge with connected hollow section in which a rod is disposed, FIG. 24 a section along the line XXIV-XXIV of FIG. 22 or respectively FIG. 23, FIG. 25 another load-bearing construction with a hollow section disposed inside the load-bearing construction in which hollow section a rod is located, FIG. 26 a section of the load-bearing construction according to FIG. 25 in the deformed state, FIG. 27 a section along the line XXVII-XXVII of FIG. 25, FIG. 28 a further load-bearing construction comprising support members, beam and a rod installed in a bent or curved way in a wall, FIG. 29 once again another load-bearing construction comprising support members, beam and a tubular rod installed in a bent or curved way in a wall, FIG. 30 a section along the line XXX-XXX of FIG. 29, and FIG. 31 a section along the line XXXI-XXXI of FIG. 30.

In the following explanation, reference is made, first of all, to FIGS. 1 to 10.

A load-bearing construction 1 for receiving a force $F_{(t)}$ applied at the upper end is shown in FIG. 1 in non-deformed state ($F_{(t)}=0$). The load-bearing elements 2 of this load-bearing construction 1 are made up of rods and beams. Located in a load-bearing element 2, designed as a steel pipe, is a cavity 5. The centroidal axis of the load-bearing construction 1 is designated by 9, and the centroidal axis of the load-bearing element 2 is designated by 8. Serving as support bed 21 for the load-bearing construction is a base 16. FIG. 2 shows a section through the load-bearing element 2 with the cavity 5.

Shown in FIG. 3 is a section of the load-bearing construction 1 according to FIG. 1 with an installed rod 4 and a filling of the remaining volume of the cavity 5 with a material 6. The rod 4 is attached to the support bed 21 in a non-displaceable way with an anchorage 3. For better understanding, a path coordinate x is introduced along the rod 4, starting from the anchorage 3. The length of the rod 2 is designated by I in FIG. 3.

According to FIG. 4 the load-bearing construction 1 is deformed as a result of the force $F_{(t)}$, which has magnitude which can vary with time. The load-bearing element 2 with the installed rod 4 deforms as illustrated in FIG. 4, in that it is stretched and thereby lengthened. With a force $F_{(t)}$ applied in opposite direction, the load-bearing element 2 would be compressed and thereby shortened. If the cavity 5 were not filled with a material 6, and the friction between rod 4 and load-bearing element 2 were to equal zero, the rod 4 would only bend along with the deformation of the load-bearing element 2. It would not change its length, however, and would have only lesser bending stresses as a result of the forced deformation. The sum of the normal stresses in each cross section of the rod 4 would be equal to zero, i.e. the normal force in the rod 4 would be equal to zero. Depending upon the magnitude of the stresses which are induced in the material 6 with the deformation of the load-bearing element 2 and rod 4, normal stresses would build up in the rod 2. The sum or the integral of these normal stresses over any cross-sectional area of the rod 4 corresponds to the normal force in the rod 4 and would not equal zero.

In FIG. 4, rod 4 in the load-bearing element 2 is surrounded by a material 6. Under a loading of the load-bearing construction 1 with the force $F_{(t)}$, not only normal forces in the rod 4, but also relative displacements Δ(x) between rod 4 and load-bearing element 2 occur.

A possible course of the relative displacements Δ(x) along the rod 4 is shown in FIG. 5. The shear stress <sic. stresses> τ(x) on the surface of the rod 4, which arise as a result of the relative displacements Δ(x), are shown in FIG. 6. Integrating the shear stresses τ(x) over the surface of the rod 4 gives the change in the normal force N(x) along the rod 4 shown in FIG. 7. For the example shown in FIG. 4, the normal force N(x) is a tensile force.

A possible relationship between relative displacement Δ and shear stress τ is shown in FIG. 8 for one loading cycle. The τ-Δ-relation shown in FIG. 8 has an elastic-plastic material behaviour. With a cyclically occurring relative displacement Δ, energy is dissipated. The dissipated energy is a function of the size of the area A within the τ-Δ-relation in one loading cycle. If the τ-Δ-relation were linear, no energy would be dissipated.

A further possible relationship between relative displacement Δ and shear stress τ is shown in FIG. 9. The τ-Δ-relation shown in FIG. 9 has a viscous material behaviour.

FIG. 10 shows a cross section through rod 4, load-bearing element 2 and the material 6. The actual form of the τ-Δ-relation is a function of the character of the surfaces of the rod 4 and of the load-bearing element 2 as well as the selection of the substance for the material 6. The τ-Δ-relations shown in FIGS. 8 and 9 are to be understood as merely exemplary material models. A multitude of different τ-Δ-relations can be produced by varying the material 6 and the surfaces of rod 4 and load-bearing element 2.

A second embodiment of the load-bearing construction 1 according to the invention is shown in FIGS. 11 and 12. The anchorage 3 for the non-displaceable holding of rod 4 and load-bearing element 2 in this example is disposed at the upper end of the load-bearing element 2. When the load-bearing construction 1 deforms as a result of the force $F_{(t)}$, a relative displacement Δ between rod 4 and load-bearing element 2 will occur. The maximum value for the relative displacement Δ will occur at the place x=0.

A third embodiment of the load-bearing construction 1 according to the invention is shown in FIGS. 13 to 15. The load-bearing construction 1 consists of a wall 15, and is stressed at the upper end by a horizontally applied force $F_{(t)}$. The load-bearing construction 1 comprises a single load-bearing element 2, which is formed by a panel. Attached to the right-hand outer face of the load-bearing construction 1 is a hollow section 10 with fixtures 11. Disposed in the hollow section 10 is a rod 4, which is connected to the base 16 by means of an anchorage 3. The embodiment of the load-bearing construction 1 according to the invention shown in this example can be produced by retro-fitting the hollow section 10, the rod 4 and the material 6 to an existing load-bearing element 2. The hollow section 10 can consist of a steel pipe or a plastic tube.

A fourth embodiment of the load-bearing construction 1 according to the invention is shown in FIGS. 16 and 17. The load-bearing construction 1 comprises a single load-bearing element 2, which is formed by a beam. The centroidal axes 8, 9 of load-bearing element 2 and load-bearing construction 1 are therefore identical in this example. A cavity 5 is created in the load-bearing construction 1, composed of reinforced concrete, by a tube 7. The tube 7 can consist of a ribbed or corrugated steel plate pipe commonly used in reinforced concrete construction. FIG. 16 shows an assembly state after the introduction of the rod 4 into the cavity 5. The rod 4 is connected to the load-bearing element 2 in a non-displaceable way in the middle by means of an anchorage 3. In a later assembly step, not shown in FIGS. 16 and 17, the cavity 5 would be filled with a material 6.

A fifth embodiment of the load-bearing construction 1 according to the invention is shown in FIG. 18. The load-bearing construction 1 consists of a plurality of load-bearing elements 2, namely a wall 15 or panel, support members 13 and beam 14. Disposed in the wall 15 is a cavity 5, which comprises multiple bends. When the load-bearing construction 1 deforms, the rod 4 disposed in the curved cavity 5 is stressed by frictional forces between rod 4 and load-bearing element 2. With a dynamic load of the load-bearing construction 1, for example through an earthquake, energy is dissipated through the frictional forces. For a proper functioning of the load-bearing construction 1 shown in FIG. 18 it is important that the diameter of the cavity 5 and the axial and bending stiffness of the rod 4 are harmonized with one another so that no buckling of the rod 4 can take place in the loading cycles, which induce in the rod 4 forces normal to the load. Under compression load, the rod 4 should impinge on the surface of the load-bearing element 2, but not be destroyed by local buckling.

A sixth embodiment of the load-bearing construction 1 according to the invention is shown in FIGS. 19 to 21. The load-bearing elements 2 of the load-bearing construction 1 shown in FIG. 19 correspond to the load-bearing construction of FIG. 18. Disposed in the wall 15 are five cavities 5, which were created by putting in tubes 7 during the manufacture of the wall 15 out of reinforced concrete. Inserted in the cavities 5 are rods 4, to which plates 12 are welded. As can be discerned in FIG. 21, the plates have holes in order to activate higher shearing stresses $\tau$ during relative displacements $\Delta$ between rod 4 and load-bearing element 2. The tubes 7 are provided with ribs on both sides, in order to, on the one hand, ensure a non-displaceable bond between tube 7 and load-bearing element 2 or respectively wall 15 and, on the other hand, generate higher shearing stresses $\tau$ during relative displacements $\Delta$ between rod 4 and load-bearing element 2.

A seventh embodiment of the load-bearing construction 1 according to the invention, in the form of a tied arch bridge 17, is shown in FIGS. 22 to 24. FIG. 22 shows the tied arch bridge 17 comprising bridge girder 19, arch 18, hanger 20 and support bed 21. The hanger 20 is made up of a round steel profile section which is connected to a hollow section 10 with fixtures 11. Disposed in the hollow section 10 is a rod 4 and a material 6. The rod 4 is connected in a non-displaceable way to the bridge girder 19 by means of an anchorage 3. The high structural damping which occurs with the relative displacement $\Delta$ between rod 4 and load-bearing element 2, or hanger 20, reduces wind-induced oscillations of the hanger 20.

An eighth embodiment of the load-bearing construction 1 according to the invention is shown in FIGS. 25 to 27. The difference between the load-bearing construction 1 shown in FIGS. 25 to 27 and the load-bearing construction 1 according to FIGS. 11 and 12 is that a hollow section 10 is disposed inside the load-bearing element 2, which hollow section is not connected to the load-bearing element 2. Thus, with a deformation of the load-bearing construction 1 by a force $F_{(t)}$, relative displacements $\Delta$ between rod 2 and hollow section 10 arise which are constant over the length of the rod. As a result of the relative displacements $\Delta$ occurring with constant magnitude along the rod 2, a greater energy dissipation along the rod length can occur, depending on the $\tau$-$\Delta$-relation, which once again depends upon on the characteristics of the material 6 and of the surface of the rod 2 and of the hollow section 10, than in the example according to FIGS. 11 and 12 with relative displacements $\Delta$ which can vary along the length of the rod.

A further embodiment of the load-bearing construction 1 according to the invention, which is similar to that of FIG. 18, is shown in FIG. 28. The load-bearing construction 1 is made up of a plurality of load-bearing elements 2, namely a wall 15 or panel, support members 13 and beam 14. Disposed in the wall 15 is a pipe or tube 7 having a plurality of bends or curves and a cavity. Disposed in the cavity of the tube 7 is a rod 4. This rod 4 can, as shown, have the cross-sectional shape of the rod 4 shown in FIG. 20 with plates. Alternatively to this, the rod 4 can have e.g. a cross-sectional shape as shown in FIG. 10. Both the tube 7 and the rod 4 are fixed at both ends by means of anchorages 3. The tube 7 is filled with a material 6. In this embodiment, in contrast to the embodiment of FIG. 18, the material 6 is displaced relative to the tube 7 and to the rod 4 when under dynamic loading, whereby energy is dissipated. The material 6 is preferably a liquid or a viscous material.

Still another embodiment of the load-bearing construction 1 according to the invention is shown in FIGS. 29 to 31. This load-bearing construction 1 is also made up of a plurality of load-bearing elements 2, namely a wall 15 or panel, support members 13 and beam 14. Disposed in the wall 15 is a pipe or tube 7 having a plurality of bends. The tube 7 is filled with a liquid material 6. In this respect this embodiment is similar to that of FIG. 28. The tube 7 is fixed at one end with an anchorage 3. It can also be anchored at both ends, however. Further anchorages can be provided for example at the bend regions. It is also possible, for example, to embed the tube 7 in concrete in the load-bearing element 2, because this also causes smaller relative displacements between tube 7 and load-bearing element 2 to occur under dynamic loading of the load-bearing element 2. In contrast to the embodiment of FIG. 28, the tube 7 in this embodiment also takes over the function of the rod 4. In other words, the tube 7 can also be regarded as tubular rod 4. Under dynamic loading, the tubular rod 4 deforms with the wall 15 and is stretched and/or compressed. The material 6 is thereby displaced relative to the tubular rod 4 since the volume of the liquid material 6 remains constant, but the volume of the cavity in the tube 7, or tubular rod 4, changes.

LIST OF REFERENCE NUMERALS

1 load-bearing construction
2 load-bearing element
3 anchorage
4 rod
5 cavity
6 material
7 tube
8 centroidal axis of the load-bearing element
9 centroidal axis of the load-bearing construction
10 hollow section
11 fixture of the hollow section
12 plate
13 support member
14 beam
15 wall
16 base
17 tied arch bridge
18 arch
19 bridge girder
20 hanger
21 support bed

The invention claimed is:

1. A load-bearing construction comprising at least one load-bearing element, characterized in that the load-bearing element has at least one cavity and at least one solid rod communicating with the cavity, the cavity being filled with a damping material, such that, when the load-bearing element is deformed, the rod is displaceable along its length relative to the load-bearing element, the rod being non-displaceably fixed at least at one point relative to the load-bearing element, the rod being designed such that it dissipates energy when a relative displacement occurs relative to the load-bearing element, wherein the cavity is formed by a tube in which said rod is disposed and said damping material in the cavity is disposed between the rod and the tube in direct contact with said tube and said rod along an entire length of said rod the total cross-sectional area of said rod being smaller than the cross-sectional area of the cavity, and the remaining volume of the cavity being filled with the damping material, wherein no plate extends from said rod in the cavity, wherein the damping material is selected from the group consisting of a) a liquid, b) a liquid with embedded components made of a solid material, c) a granular material, d) a gas and e) combinations thereof, in which the liquid of elements a) and b) remains in liquid form during displacement of the rod along its length.

2. The load-bearing construction according to claim 1, characterized in that the rod is non-displaceably fixed at only one point relative to the load-bearing element and is designed such that it dissipates energy upon the occurrence of a relative displacement relative to the load-bearing element.

3. The load-bearing construction according to claim 1, characterized in that the length of the cavity amounts to at least ten times its greatest diameter.

4. The load-bearing construction according to claim 1, characterized in that the cavity has a cylindrical or prismatic shape.

5. The load-bearing construction according to claim 1, characterized in that the rod is composed of a metallic material or a fiber-reinforced composite.

6. The load-bearing construction according to claim 1, characterized in that the surface of the rod and/or the inner surface of the cavity has/have a ribbing, a threading, a pattern, swelling or indentations.

7. The load-bearing construction according to claim 1, characterized in that strip-shaped, prismatic or cylindrical elements are attached to the surface of the rod.

8. The load-bearing construction according to claim 1, characterized in that the liquid damping material is selected from the group consisting of water, hydraulic fluid or silicon oils, having kinematic viscosity between 10-6 [m2/s] to 1 [m2/s].

9. The load-bearing construction according to claim 1, wherein the damping material includes the granular material, characterized in that the granular damping material is selected from the group consisting of sand, gravel, steel balls, balls of plastic, balls of aluminium or metallic balls with a plastic coating.

10. The load-bearing construction according to claim 1, characterized in that the damping material includes the liquid with embedded components made of a solid material.

11. The load-bearing construction according to claim 1, characterized in that the rod and/or the damping material are replaceable.

12. The load-bearing construction according to claim 1, characterized in that the cavity is sealably closable.

13. The load-bearing construction according to claim 1, characterized in that the cavity in the load-bearing element is disposed at a distance from the centroidal axis of the load-bearing element.

14. The load-bearing construction according to claim 1, characterized in that dimensions of the load-bearing construction along its centroidal axis are at least ten times greater than cross sections disposed in the orthogonal to the centroidal axis, and in that the load-bearing element is disposed approximately parallel to, and at a spacing apart from, the centroidal axis of the load-bearing construction.

15. The load-bearing construction according to claim 1, characterized in that the load-bearing element is composed of concrete or masonry in which said tube is disposed.

16. The load-bearing construction according to claim 15, characterized in that the surface of the tube facing the cavity and/or the surface of the tube facing the load-bearing element have a ribbing, a pattern, swelling or indentations.

17. A load-bearing construction comprising at least one load-bearing element, characterized in that the load-bearing element has at least one cavity and at least one rod communicating with the cavity, the cavity being filled with a damping material, such that, when the load-bearing element is deformed, the rod is displaceable along its length relative to the load-bearing element, the rod being non-displaceably fixed at least at one point relative to the load-bearing element, the rod being designed such that it dissipates energy when a relative displacement occurs relative to the load-bearing element, wherein the damping material includes a gas alone, said gas comprising air or nitrogen, or said gas in combination with at least one component selected from the group consisting of a) a liquid, b) a liquid with embedded components made of a solid material, and c) a granular material, in which the liquid of elements a) and b) remains in liquid form during displacement of the rod along its length.

18. A load-bearing construction comprising at least one load-bearing element, characterized in that the load-bearing element has at least one cavity and at least one rod communicating with the cavity, the cavity being filled with a damping material, such that, when the load-bearing element is deformed, the rod is displaceable along its length relative to the load-bearing element, the rod being non-displaceably fixed at least at one point relative to the load-bearing element, the rod being designed such that it dissipates energy when a relative displacement occurs relative to the load-bearing element, wherein the damping material is selected from the group consisting of a) a liquid, b) a liquid with embedded components made of a solid material, c) a granular material, d) a gas and e) combinations thereof, in which the liquid of elements a) and b) remains in liquid form during displacement of the rod along its length characterized in that the cavity has a plurality of bends that are spaced from each other along a longitudinal direction of said load bearing element.

19. A load-bearing construction comprising at least one load-bearing element and at least one rod, wherein when the load-bearing element is deformed the rod is displaceable along its length relative to the load-bearing element, the rod being non-displaceably fixed at least at one point relative to the load-bearing element, the rod being designed such that it dissipates energy when a relative displacement occurs relative to the load-bearing element, characterized in that the rod is disposed outside the load-bearing element in a hollow section, in that the hollow section is disposed next to the load-bearing element and is firmly connected thereto at at least three points, in that the cross-sectional area of the rod is smaller than the inner cross-sectional area of the hollow section and in that the remaining volume in the hollow section is filled with a damping material that is selected from the group consisting of a) a liquid, b) a liquid with embedded components made of a solid material, c) a granular material, d) a gas and e) combinations thereof, in which the liquid of elements a) and b) remains in liquid form during displacement of the rod along its length.

* * * * *